US006182553B1

(12) United States Patent
Peterson

(10) Patent No.: US 6,182,553 B1
(45) Date of Patent: Feb. 6, 2001

(54) BOAT DEPLOYED EXPLOSIVE NET ASSEMBLY

(75) Inventor: Ronald S. Peterson, Panama City Beach, FL (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/273,816

(22) Filed: Mar. 22, 1999

(51) Int. Cl.[7] ..... F41H 11/14
(52) U.S. Cl. ..... 89/1.11; 102/403
(58) Field of Search ..... 89/1.1, 1.11, 36.17; 102/403

(56) References Cited

U.S. PATENT DOCUMENTS

| | | | | |
|---|---|---|---|---|
| 2,299,327 | * | 10/1942 | Johnson | 89/1.11 |
| 4,625,668 | * | 12/1986 | Fitch | 114/14 |
| 4,768,417 | * | 9/1988 | Wright | 89/1.11 |
| 5,071,286 | * | 12/1991 | Separovich | 405/66 |
| 5,417,139 | * | 5/1995 | Bioggs et al. | 89/1.11 |
| 5,437,230 | * | 8/1995 | Harris et al. | 102/302 |
| 5,524,524 | * | 6/1996 | Richards et al. | 89/1.11 |

* cited by examiner

*Primary Examiner*—Stephen M. Johnson
(74) *Attorney, Agent, or Firm*—Harvey A. Gilbert; Donald G. Peck

(57) ABSTRACT

A boat deployed explosive net assembly includes a boat, an elongated tray, a pair of pontoons, an explosive net and one or more drogue devices. The boat is floatable on and movable along a surface of a body of water, such as a surf zone. The tray includes an outer member and a pair of inner members. The outer member is rotatably mounted to the boat such that the tray is movable between a transport position in which it is aligned in generally parallel relation to the direction of movement of the boat and a deployed position in which it is aligned in generally transverse relation to the direction of movement of the boat. Each inner member is mounted to and disposed within an interior cavity of the outer member and telescopingly movable in relation to the outer member between retracted and extended condition. Each pontoon is floatable on and movable along the surf zone and mounted to one of the inner members of the tray. The explosive net is movable between a stored condition in which the explosive net is gathered within interior cavities of the inner members of the tray and a deployed condition in which the explosive net is spread over a portion of the surf zone.

20 Claims, 2 Drawing Sheets

BOAT DEPLOYED EXPLOSIVE NET ASSEMBLY

BACKGROUND OF THE INVENTION

1. Field of the Invention

The present invention generally relates to explosive devices and, more particularly, is concerned with a boat deployed explosive net assembly.

2. Description of the Prior Art

The United States military would benefit from an improved capability to clear explosive devices, such as mines, in a surf zone of a beach in advance of a beach assault. Rockets and self-powered or gliding aircraft have been developed for deploying line charges and explosive nets. Rockets and aircraft, however, pose deficiencies related to cost and logistics.

As described in U.S. Pat. No. 5,524,524 to Richards et al., many techniques have been developed over the years for clearing safe pathways across minefields on land and below water. Most methods have involved the detonation or removal of the explosive devices. Line charges and explosive nets have commonly been employed. By way of example, an explosive net may be deployed from a safe distance using rockets to carry a leading end of the net over a minefield while a trailing end of the net remains attached to a box the net was stored in. Explosives on the net are detonated to destroy mines which are located proximate to the charges. While prior art designs appear to be satisfactory in use for the specific purposes for which they were designed, none of them seem to provide an optimumly effective solution for the detonation of mines in a surf zone.

Consequently, a need still exists for an alternative approach which provides a cost and logistically effective solution to the aforementioned problem in the prior art without introducing any new problems in place thereof.

SUMMARY OF THE INVENTION

The present invention provides a boat deployed explosive net assembly designed to satisfy the aforementioned need. The boat deployed explosive net assembly of the present invention includes a remotely controlled boat, an explosive net and a tray rotatably mounted to the boat for carrying and deploying the net. The boat deployed explosive net assembly can be constructed and deployed with less cost than prior art designs which use rockets or aircraft. The boat deployed explosive net assembly can also be moved to and used to detonate mines of a surf zone with less effort and more accuracy than the prior art designs which use rockets or aircraft.

Accordingly, the present invention is directed to a boat deployable explosive net assembly which comprises: (a) a boat floatable on and movable along a surface of a body of water in a given direction of travel; (b) an elongated tray mounted to the boat and adapted to undergo rotational movement relative to the boat between a transport position in which the tray is aligned in a generally parallel relation to the direction of travel of the boat and a deployed position in which the tray is aligned in a generally transverse relation to the direction of travel of the boat, the tray also adapted to undergo telescoping movement between a retracted condition in which the tray has a first length and an extended condition in which the tray has a second length greater than the first length; and (c) an explosive net carried by the tray in a stored condition when the tray is in the transport position and retracted condition and during movement to the deployed position and extended condition, the explosive net being deployable from the tray when the tray is in the deployed position and extended condition.

More particularly, the tray includes an outer member, a pivot member and a pair of inner members. The outer member has a top, a pair of opposite ends and a pair of opposite portions defining an interior cavity extending along the opposite portions between the opposite ends and open along the top of the outer member. The pivot member pivotally mounts the outer member to the boat such that the opposite portions of the outer member extend in opposite directions away from the pivot member and the pivot member adapts the outer member to undergo the rotational movement between the transport and deployed positions relative to the boat. Each of the inner members has a top and a pair of opposite ends and defines an interior compartment extending between the opposite ends and open along the top of the inner member. Each inner member is slidably mounted within the interior cavity of the outer member along a respective one of the end portions thereof and is telescopingly movable in relation to the outer member toward and away from the pivot member between the retracted condition of the tray in which the inner members are disposed substantially within the interior cavity of the outer member providing the tray at the first length and the extended condition of the tray in which the inner members are disposed substantially exteriorly of the outer member providing the tray at the second length. The explosive net is carried in the interior compartments of the inner members of the tray when the tray is in the transport and deployed positions and retracted condition and is carried in the interior cavity of the outer member and the interior compartments of the inner members during movement of the tray to and when the tray is at the deployed position and extended condition.

The assembly further comprises a pair of pontoons and one or more drogue devices. Each pontoon is floatable on and movable along the surface of the body of water and mounted adjacent to a respective one of a pair of opposite ends of the tray. The drogue devices are mounted to the explosive net for deploying therewith so as to remain substantially in place relative to the surface of the body of water for pulling the explosive net from the tray as the boat moves away from the drogue devices and thereby substantially spreads the explosive net over a portion of the surface of the water.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
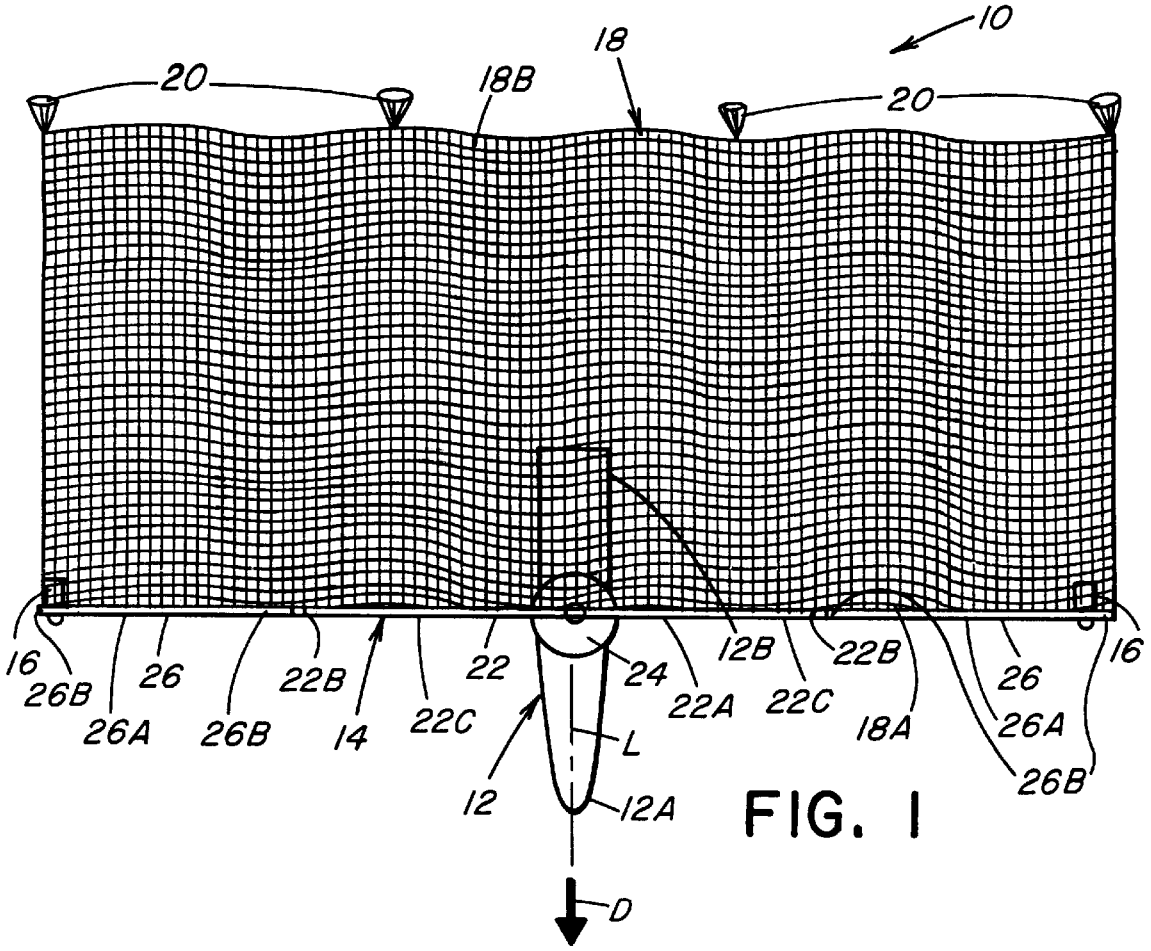
FIG. 1 is a top schematic view of a boat deployed explosive net assembly of the present invention showing a telescopable tray of the assembly in a deployed position and extended condition after an explosive net is deployed from the tray.

Referring to the drawings and particularly to FIG. 1, there is illustrated a boat deployed explosive net assembly, generally designated 10, of the present invention. Basically, the boat deployed explosive net assembly 10 includes a boat 12, an elongated tray 14, a pair of pontoons 16, an explosive net 18 and one or more drogue devices 20. The assembly 10 is intended for use on a surface of a body of water (not shown) for clearing mines in a surf zone in advance of a beach assault.

Referring now to FIGS. 1 and 2A to 2C, the boat 12 of the assembly 10 is floatable on and movable along the water surface in a desired direction of travel D which is aligned generally parallel with a longitudinal centerline L of the the boat 12 extending from its bow or front end 12A to its stern or rear end 12B. The boat 12 can be one generally known as a planing boat and has a substantially elongated configuration. The boat 12 can have a length of approximately 50 feet and a width of approximately 10 to 12 feet, but can have any other suitable length and width. The boat 12 has a minimum draft and preferably is waterjet-propelled to allow the boat 12 to fully transit the surf zone and impact the beach with minimum chance of impacting the bottom of the body of water before reaching the beach. The boat 12 is made of a substantially light and high-strength material, such as fiberglass, or any other suitable material.

Figure 3:
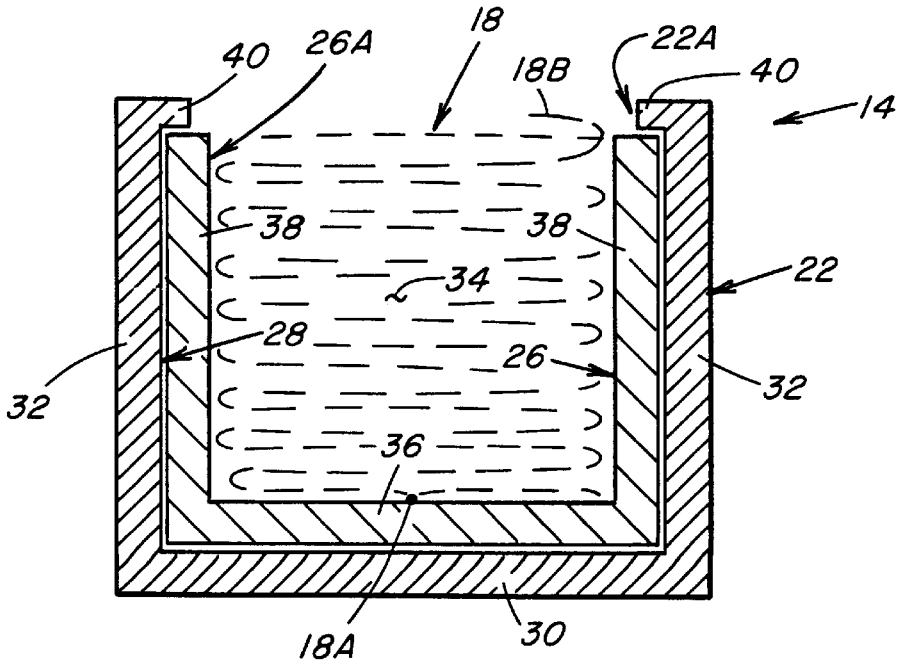
FIG. 3 is an enlarged cross-section of the telescopable tray taken along line 3—3 of FIG. 2B.
Figure 2A:
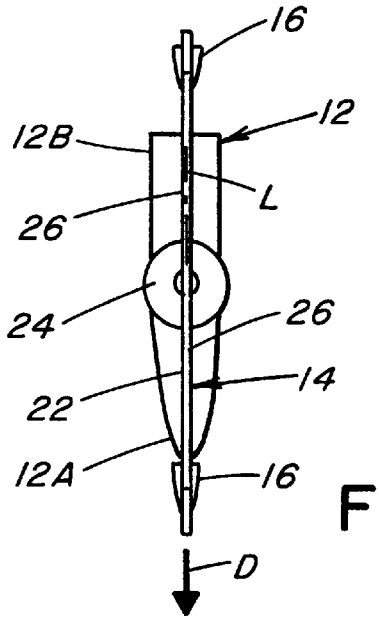
FIG. 2A is a top schematic view of the assembly showing the tray in a transport position and retracted condition.
Figure 2B:
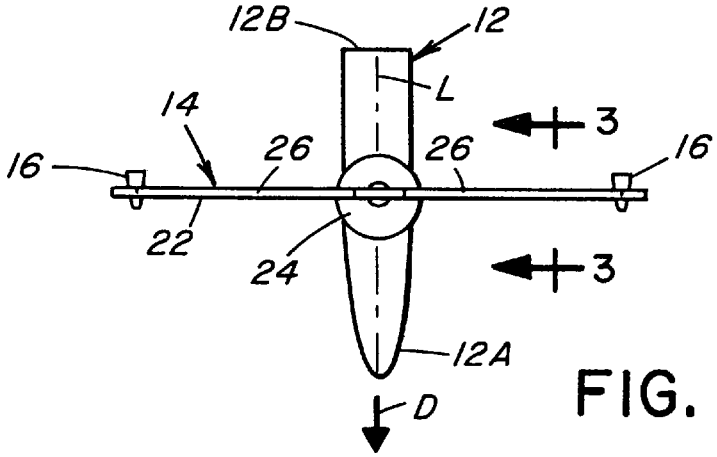
FIG. 2B is a top schematic view of the assembly showing the tray in a deployed position and retracted condition.
Figure 2C:
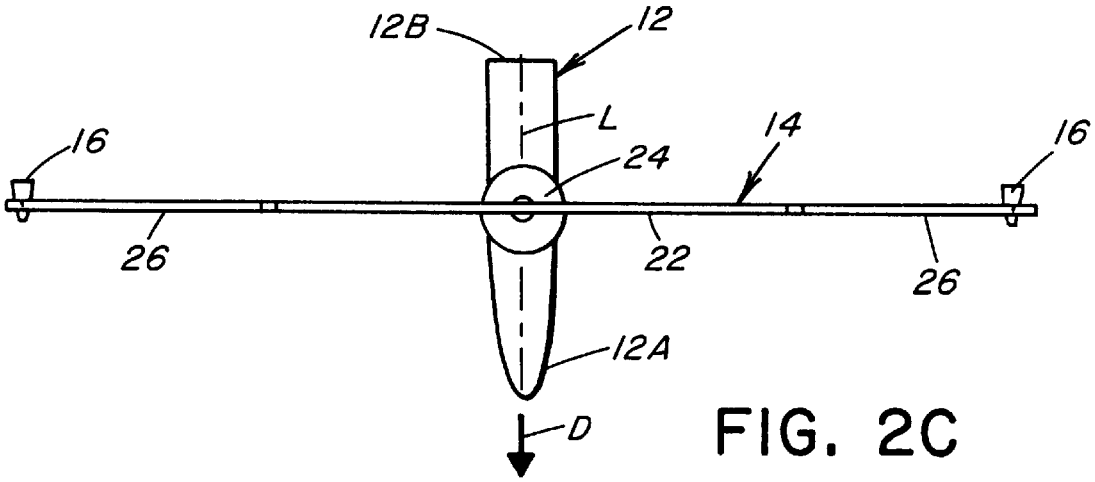
FIG. 2C is a top schematic view of the assembly showing the tray is the deployed position and extended condition as in FIG. 1 but before the explosive net is deployed from the tray.

Referring now to FIGS. 1 to 3, the elongated tray 14 of the assembly 10 is mounted to the boat 12 and adapted to undergo rotational movement relative to the boat 12 between a transport position, as seen in FIG. 2A, and a deployed position, seen in FIGS. 1, 2B and 2C. In the transport position, the tray 14 is aligned in generally parallel relation to the direction of travel D and longitudinal centerline L of the boat 12. In the deployed position, the tray 14 is aligned in generally transverse relation to the direction of travel D and longitudinal centerline L of the boat. The elongated tray 14 also is adapted to undergo telescoping movement between a retracted condition, as seen in FIGS. 2A and 2B, and an extended condition, as seen in FIGS. 1 and 2C. In the retracted condition, the tray 14 has a first, or minimum, length; in the extended condition, the tray 14 has a second, or maximum, length greater than the first length. Basically, the elongated tray 14 includes an outer member 22, a pivot member 24 rotatably mounting the outer member 22 to the boat 12, and a pair of inner members 26 telescopically movable relative to the outer member 22.

The outer member 22 of the elongated tray 14 has a top 22A, a pair of opposite ends 22B and a pair of opposite portions 22C defining an interior cavity 28 extending along the opposite portions 22C between the opposite ends 22B and open along the top 22A of the outer member 22. The outer member 22 further has a bottom wall 30 and opposite side walls 32 providing the outer member 22 with a generally U-shaped configuration in transverse cross-section, as shown in FIG. 3, and defining the interior cavity 28 open along the top 22A of the outer member 22.

The pivot member 24 of the elongated tray 14 may take the form of a turn style and pivotally mounts the outer member 22 to the boat 12 such that the opposite portions 22C of the outer member 22 extend in opposite directions away from the pivot member 24. The pivot member 24 adapts the outer member 22 to undergo the rotational movement between the above-described transport and deployed positions relative to the boat 12. Particularly, the outer member 22 is rotatably mounted upon the boat 12 by the pivot member 24 such that the outer member 22 is preferably vertically disposed 6 to 8 feet above the surface of the water. The pivot member 24 may be centrally located on the boat 12 and generally disposed on the longitudinal centerline L of the boat 12.

Each of the inner members 26 has a top 26A and a pair of opposite ends 26B and defines an interior compartment 34 extending between the opposite ends 26B and open along the top 26A of the inner member 26. Each inner member 26 further has a bottom wall 36 and opposite side walls 38 providing the inner member 26 with a substantially U-shaped configuration in transverse cross-section, as shown in FIG. 3, and defining the interior cavity 34 open along the top 26A of the inner member 26. Each inner member 26 is slidably mounted within the interior cavity 28 of the outer member 22 along a respective one of the opposite portions 22C thereof and is telescopingly movable in relation to the outer member 22 toward and away from the pivot member 24 between the retracted condition of the tray 14, as seen in FIGS. 2A and 2B, in which the inner members 26 are disposed substantially within the interior cavity 28 of the outer member 22 providing the tray 14 at the first or minimum length and the extended condition of the tray 14, as seen in FIGS. 1 and 2C, in which the inner members 26 are disposed substantially exteriorly of the outer member 22 providing the tray 14 at the second or maximum length.

The outer member 22 of the tray 14 also has a pair of opposite ledges 40. Each ledge 40 extends interiorly from the upper edge of one of the opposite side walls 32 of the outer member 22 so as to partially overlie upper edges of the side walls 38 of the respective inner members 26. For example, each ledge 40 extends approximately half of the width of one of the opposite side walls 38 of the inner members 26. The opposite ledges 40 in combination with the opposite side walls 32 and bottom wall 30 of the outer member 22 capture and prevent vertical movement of the inner members 22 within the interior cavity 28 of the outer member 22 away from the bottom wall 30 thereof. By way of example, the outer member 22 can have a length of approximately 100 feet or any other suitable length. Each of the inner members 26 has a length less than half of the length of the outer member 22. As seen in FIG. 3, the cross-sectional size of each inner member 26 is slightly less in width and height than that of the outer member 22 such that the inner members 26 snugly but slidably fit therewithin. For purposes of facilitating movement of the inner members 22 away from the pivot member 24 from the retracted to extended condition of the tray 14, the opposite portions 22C of the outer member 22 going from the pivot member 24 to the opposite ends 22B of the outer member 22 may slope downwardly relative to a horizontal reference plane so that each inner member 26 is movable by the influence of the force of gravity or a suitable mechanical means to the extended condition of the tray 14. Each inner member 26 is normally held in the retracted condition of the tray 14 within the interior cavity 28 of the outer member 22 thereof by suitable latching means. When unlatched, the inner member 26 automatically moves, respectively, in opposite directions away from the pivot member 24 from the retracted condition to the extended condition. The latching means is automatically unlatched when the tray 14 reaches its deployed position shown in FIG. 2C upon rotation from its transport position. Each of the outer and inner members 22, 26 is made of a substantially light and high-strength material, such as fiberglass, or any other suitable material.

Each pontoon 16 of the assembly 10 is mounted adjacent to a respective one of the opposite ends 26B of each of the inner member 26 of the tray 14. Each pontoon 16 is floatable upon the water and thus movable with the tray 14 along the surface of the water. Each pontoon 16 has a configuration which substantially resembles, though on a reduced scale, the configuration of the boat 12. The pontoon 16 has a suitable height for keeping the one opposite end 26B of the respective inner member 26 of the tray 14 to which it is mounted out of the water. Each pontoon 16 is made of a substantially light and high-strength material, such as fiberglass, or any other suitable material.

The explosive net 18 has opposite forward or leading and rearward or trailing ends 18A, 18B. The forward end 18A is mounted along the inner members 22 of the tray 12. The explosive net 18 is movable between a stored condition in which it is gathered and carried wholly within the interior compartments 34 of the inner members 26 of the tray 14 when the tray 14 is in the transport position of FIGS. 2A and 2B, and a deployed condition in which it is payed out from the interior compartments 34 of the inner members 26 of the tray 14 and substantially spread over a portion of the surface of the water. In FIG. 1, the explosive net 18 is shown at least partially payed out. The explosive net 18 has a substantially rectangular configuration, though may have any other suitable configuration. The net 18 can have a length of approximately 80 yards and a width of approximately 55 yards when fully extended. This size of net 18 has a weight of approximately 3,000 pounds and has a volume of approximately 180 cubic feet when packaged. This size of net 18 covers about half of a surf zone of 150 yards by 50 yards. The net 18 may have any other suitable size and weight. The explosive net 18 is comprised of any suitable conventional material.

The drogue devices 20 are mounted to the trailing or rearward end 18B of the net 18 and, upon movement of the tray 14 to its retracted to extended condition, will drop into the body of water and pull the net 18 from the interior compartments 34 of the inner members 26 of the tray 14. The drogue devices 20 once deployed with the net 18 will remain substantially in place relative to the surface of the body of water and so hold the rearward end 18 of the net 18 in place also on or just below the surface of the body of water as the boat 12 continues to move away from the drogue devices 20 and rearward end 18B of the net 18 causing the net 18 to spread substantially over the portion of the surface of the water at the surf zone. The drogue devices 20 are spaced approximately an equal distance apart from one another along the trailing end 72 of the net 18 or may have any other suitable arrangement. Each drogue device 20 could be a substantially parachute-shaped configuration, though may have any other suitable configuration. Each drogue device 20 has a size approximately similar to that of one of the pontoons 16, though may have any other suitable size.

In addition to explosives (not shown) being incorporated in a known manner in the net 18, explosives (not shown) also are mounted to one or more of and, preferably, to each of the boat 12, tray 14 and pontoons 16. The explosives, through remote actuation, are detonated once the explosive net 18 is in a fully deployed position. The explosives are of any suitable type. Destruction of the boat 12, tray 14 and pontoons 16 prevents them from becoming obstacles themselves.

The assembly 10 further includes a suitable known remote control means for controlling movement of the boat 12. The remote control means may set the boat 12 in transit up to 20 to 25 kt from a seaward launch point to a point at or near the surf zone. The assembly 10 further includes any suitable means for controlling rotation of the tray 14 between the transport position and deployed position. For example, the tray 14 could be spring-biased to move from the transport to deployed position by remote actuation of a pin or latch that would release the tray 14 from the transport position. The tray 14 moves 90 degrees from the transport position to deployed position. As mentioned above, the assembly 10 further has any suitable latch means for latching the inner members 26 of the tray 14 to the outer member 22 thereof so as to retain the tray 14 in the retracted condiiton. Upon the tray 14 rotating to its transverse deployed position of FIG. 2B, such latch means is automatically tripped permitting the inner members 26 to unlatch from the outer member 22 and slide relative thereto away from the pivot member 24 from the retracted to extended condition of the tray 14. Any well-known suitable means can be employed for detonating the explosives from a remote location.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A boat deployable explosive net assembly, comprising:

(a) a boat floatable on and movable along a surface of a body of water in a given direction of travel;

(b) an elongated tray mounted to said boat and adapted to undergo rotational movement relative to said boat between a transport position in which said tray is aligned in a generally parallel relation to said direction of travel of said boat and a deployed position in which said tray is aligned in a generally transverse relation to said direction of travel of said boat, said tray also adapted to undergo telescoping movement between a retracted condition in which said tray has a first length and an extended condition in which said tray has a second length greater than said first length; and (c) an explosive net carried by said tray in a stored condition when said tray is in said transport position and said retracted condition and during movement to said deployed position and said extended condition, said explosive net being deployable from said tray when said tray is in said deployed position and said extended condition.

2. The assembly of claim 1 further comprising:

a pair of pontoons each floatable on and movable along the surface of the body of water and mounted adjacent to a respective one of a pair of opposite ends of said tray.

3. The assembly of claim 1 further comprising:

one or more drogue devices mounted to said explodable net for deploying therewith so as to remain substantially in place relative to the surface of the body of water for pulling said explosive net from said tray as said boat moves away from said drogue devices and thereby substantially spreads said explosive net over a portion of the surface of the water.

4. The assembly of claim 1 wherein said tray includes an outer member having a top, a pair of opposite ends and a pair of opposite portions defining an interior cavity extending along said opposite portions between said opposite ends and open along said top of said outer member.

5. The assembly of claim 4 wherein said outer member further has a bottom wall and a pair of opposite side walls providing said outer member with a substantially U-shaped configuration in transverse cross-section and defining said interior cavity with said open top.

6. The assembly of claim 4 wherein said tray further includes a pivot member pivotally mounting said outer member to said boat such that said opposite portions of said outer member extend in opposite directions away from said pivot member and said pivot member adapts said outer member to undergo said rotational movement between said stored and deployed positions relative to said boat.

7. The assembly of claim 4 wherein said tray further includes a pair of inner members each having a top and a pair of opposite ends and defining an interior compartment extending between said opposite ends and open along said top of said inner member, each of said inner members being slidably mounted within said interior cavity of said outer member along a respective one of said end portions of said outer member and being telescopingly movable in relation to said outer member between said retracted condition of said tray in which said inner members are disposed substantially within said interior cavity of said outer member providing said tray at said first length and said extended condition of said tray in which said inner members are disposed substantially exteriorly of said outer member providing said tray at said second length.

8. The assembly of claim 7 wherein each of said inner members further has a bottom wall and a pair of opposite side walls providing said inner member with a substantially U-shaped configuration in transverse cross-section and defining said interior compartment with said open top.

9. The assembly of claim 7 wherein said explosive net is carried in said interior compartments of said inner members of said tray when said tray is in said transport and deployed positions and said retracted condition and is carried in said interior cavity of said outer member and said interior compartments of said inner members during movement of said tray to and when said tray is at said deployed position and extended condition.

10. The assembly of claim 7 wherein said explosive net has opposite trailing and forward ends, said forward end of said explosive net being attached to said outer and inner members of said tray, said explosive net being movable between a stored condition in which said explosive net is gathered within said interior cavity of said outer member and interior compartments of said inner members of said tray and an expanded condition in which said explosive net is payed out from said interior cavity of said outer member and interior compartments of said inner members of said tray and spread over a portion of the surface of the water behind said boat.

11. The assembly of claim 10 further comprising:

one or more drogue devices mounted to said trailing end of said explosive net for deploying therewith from said tray so as to remain substantially in place relative to the surface of the body of water for pulling said explosive net from said interior cavity of said outer member and interior compartments of said inner members of said tray as said boat moves away from said drogue devices and thereby substantially spreads said explosive net over the portion of the surface of the water.

12. A boat deployable explosive net assembly, comprising:

(a) a boat floatable on and movable along a surface of a body of water in a given direction of travel;

(b) an elongated tray mounted to said boat and adapted to undergo rotational movement relative to said boat between a transport position in which said tray is aligned in a generally parallel relation to said direction of travel of said boat and a deployed position in which said tray is aligned in a generally transverse relation to said direction of travel of said boat, said tray also adapted to undergo telescoping movement between a retracted condition in which said tray has a first length and an extended condition in which said tray has a second length greater than said first length, said tray including (i) an outer member having a top, a pair of opposite ends and a pair of opposite portions defining an interior cavity extending along said opposite portions between said opposite ends and open along said top of said outer member, (ii) a pivot member pivotally mounting said outer member to said boat such that said opposite portions of said outer member extend in opposite directions away from said pivot member and said pivot member adapts said outer member to undergo said rotational movement between said transport and deployed positions relative to said boat, and (iii) a pair of inner members each having a top and a pair of opposite ends and defining an interior compartment extending between said opposite ends and open along said top of said inner member, each of said inner members being slidably mounted within said interior cavity of said outer member along a respective one of said end portions of said outer member and being telescopingly movable in relation to said outer member between said retracted condition of said tray in which said inner members are disposed substantially within said interior cavity of said outer member providing said tray at said first length and said extended condition of said tray in which said inner members are disposed substantially exteriorly of said outer member providing said tray at said second length;

(c) an explosive net carried by said tray in a stored condition when said tray is in said transport position and said retracted condition and during movement to said deployed position and said extended condition, said explosive net being deployable from said tray when said tray is in said deployed position and said extended condition; and (d) a pair of pontoons each floatable on and movable along the surface of the body of water and mounted adjacent to a respective one of said opposite ends of each of said inner members of said tray located farthest from said pivot member.

13. The assembly of claim 12 further comprising:

one or more drogue devices mounted to said explosive net for deploying therewith so as to remain substantially in place relative to the surface of the body of water for pulling said explosive net from said tray as said boat moves away from said drogue devices and thereby substantially spreads said explosive net over a portion of the surface of the water.

14. The assembly of claim 12 wherein said outer member further has a bottom wall and a pair of opposite side walls providing said outer member with a substantially U-shaped configuration in transverse cross-section and defining said interior cavity with said open top.

15. The assembly of claim 14 wherein each of said inner members further has a bottom wall and a pair of opposite side walls providing said inner member with a substantially U-shaped configuration in transverse cross-section and defining said interior compartment with said open top.

16. The assembly of claim 15 wherein said outer member has opposite ledges each extending inwardly toward one another from one of said opposite side walls of said outer member, said opposite ledges in combination with said opposite side walls of said outer member and said bottom wall of said outer member capturing and preventing movement of said inner members away from said bottom wall of said outer member and through said open top of said outer member.

17. The assembly of claim 12 wherein said explosive net is carried in said interior compartments of said inner members of said tray when said tray is in said transport and deployed positions and said retracted condition and is carried in said interior cavity of said outer member and said interior compartments of said inner members during movement of said tray to and when said tray is at said deployed position and extended condition.

18. The assembly of claim 12 wherein said explosive net has opposite trailing and forward ends, said forward end of said explosive net being attached to said outer and inner members of said tray, said explosive net being movable between a stored condition in which said explosive net is gathered within said interior cavity of said outer member and interior compartments of said inner members of said tray and an expanded condition in which said explosive net is payed out from said interior cavity of said outer member and interior compartments of said inner members of said tray and spread over a portion of the surface of the water behind said boat.

19. The assembly of claim 12 wherein each of said inner members of said tray has a length less than one-half of a length of said outer member of said tray.

20. The assembly of claim 12 wherein said first length is a minimum length of said tray and said second length is a maximum length of said tray.

* * * * *